US011313064B2

(12) United States Patent
Lee

(10) Patent No.: US 11,313,064 B2
(45) Date of Patent: Apr. 26, 2022

(54) APPARATUS AND METHOD FOR TREATING LAUNDRY

(71) Applicant: LG ELECTRONICS INC., Seoul (KR)

(72) Inventor: Seung Jun Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 169 days.

(21) Appl. No.: 16/579,040

(22) Filed: Sep. 23, 2019

(65) Prior Publication Data

US 2020/0018005 A1 Jan. 16, 2020

(30) Foreign Application Priority Data

May 9, 2019 (WO) ..... PCT/KR2019/005577

(51) Int. Cl.

| | |
|---|---|
| ***D06F 33/36*** | (2020.01) |
| ***D06F 34/18*** | (2020.01) |
| *D06F 103/00* | (2020.01) |
| *D06F 103/02* | (2020.01) |
| *D06F 103/04* | (2020.01) |
| *D06F 103/06* | (2020.01) |
| *D06F 103/40* | (2020.01) |
| *D06F 105/52* | (2020.01) |
| *D06F 105/58* | (2020.01) |
| *D06F 105/60* | (2020.01) |

(52) U.S. Cl.

CPC ..... *D06F 33/36* (2020.02); *D06F 34/18* (2020.02); *D06F 2103/00* (2020.02); *D06F 2103/02* (2020.02); *D06F 2103/04* (2020.02); *D06F 2103/06* (2020.02); *D06F 2103/40* (2020.02); *D06F 2105/52* (2020.02); *D06F 2105/58* (2020.02); *D06F 2105/60* (2020.02)

(58) Field of Classification Search

None

See application file for complete search history.

(56) References Cited

U.S. PATENT DOCUMENTS

2017/0254011 A1* 9/2017 Kweon ..... D06F 39/02

FOREIGN PATENT DOCUMENTS

KR 10-2013-0044764 A 5/2013
KR 10-2013-0139118 A 12/2013
(Continued)

OTHER PUBLICATIONS

Espacenet translation KR20160032474A Washing Machine and Controlling Method Thereof, 2016 (Year: 2016).*

*Primary Examiner* — Cristi J Tate-Sims

(74) *Attorney, Agent, or Firm* — Birch, Stewart, Kolasch & Birch, LLP

(57) ABSTRACT

A method and an apparatus for treating laundry are disclosed. The method for treating laundry according to an embodiment of the present disclosure includes generating fusion sensing data on laundry by using a plurality of heterogeneous sensors, acquiring information about the laundry using the fusion sensing data, and controlling a washing cycle of the laundry based on the information about the laundry. According to the present disclosure, it is possible to collect accurate information about the laundry by using the fusion sensing data based on the heterogeneous sensors, and to control the washing cycle in a manner suitable for the laundry based on the collected information.

8 Claims, 8 Drawing Sheets

(56) References Cited

FOREIGN PATENT DOCUMENTS

| | | | | |
|---|---|---|---|---|
| KR | 10-2015-0105844 | A | 9/2015 | |
| KR | 10-2016-0032474 | A | 3/2016 | |
| KR | 10-2017-0090164 | A | 8/2017 | |
| KR | 10-1841248 | B1 | 3/2018 | |
| WO | WO 2017/150694 | A1 | 9/2017 | |
| WO | WO-2019122281 | A1 * | 6/2019 | ..... D06F 75/12 |

* cited by examiner

APPARATUS AND METHOD FOR TREATING LAUNDRY

CROSS-REFERENCE TO RELATED APPLICATION

This present application claims benefit of PCT Patent Application No. PCT/KR2019/005577, entitled "APPARATUS AND METHOD FOR TREATING LAUNDRY," filed on May 9, 2019, in the World Intellectual Property Organization, both of which are incorporated herein by reference.

TECHNICAL FIELD

The present disclosure relates to an apparatus and a method for treating laundry. More particularly, the present disclosure relates to an apparatus and a method for treating laundry in which information about laundry is collected by using an artificial intelligence algorithm and a technology for processing fusion sensing data based on a light sensor and a wave sensor, and a washing cycle of the laundry is controlled by using the collected information.

BACKGROUND ART

A laundry treating apparatus is an apparatus for laundry treatment such as washing and drying laundry.

When laundry is introduced into the laundry treating apparatus, a user sets a washing course depending on a type of the laundry, a volume or weight of the laundry, and a degree of contamination of the laundry. For example, the user sets whether a soaking operation is to be performed, the number of times washing, rinsing, and dehydrating operations are to be performed, and whether a drying operation is to be performed. When a parameter value corresponding to the set course is inputted to the laundry treating apparatus, the laundry treating apparatus performs an operation in response to the inputted parameter value.

A recent technology introduced into laundry treating apparatuses allows an amount of laundry to be measured by means of a weight sensor, and a type of laundry to be sensed through a camera.

In particular, Korean Patent Application Publication No. 10-2013-0044764 (hereinafter referred to as "Related Art 1") discloses a technology for sensing a type of laundry by means of a camera, and selecting a washing course depending on the type of the laundry.

However, according to Related Art 1, the camera is mounted on the outer front surface of a washing machine, and thus there is a problem in that a user needs to hold each individual piece of laundry in front of the camera such that the laundry can be photographed by the camera, before introducing the laundry into the washing machine.

In addition, Korean Patent Application Publication No. 10-2015-0105844 (hereinafter referred to as "Related Art 2") discloses a control device for a washing machine including a fabric sensing unit for sensing a fabric texture of laundry.

However, according to Related Art 2, a value of frictional resistance resulting from contact with the laundry is used to sense fabric texture. Yet since Related Art 2 does not specifically disclose a type of sensor used, sensing accuracy and feasibility of the invention are problematic.

RELATED ART DOCUMENT

Related Art 1: Korean Patent Application Publication No. 10-2013-0044764 (published on May 3, 2013)

Related Art 2: Korean Patent Application Publication No. 10-2015-0105844 (published on Sep. 18, 2015)

DISCLOSURE OF INVENTION

Technical Problem

The present disclosure is directed to solving the conventional problem in which the accuracy of differentiating pieces of laundry is insufficient due to laundry information being extracted only with an image photographed by a general visible light camera.

The present disclosure is further directed to solving the conventional problem in which a foreign substance mixed with laundry cannot be easily sensed using only an image sensor that uses visible light.

The present disclosure is still further directed to solving the conventional problem in which, much time and data are required for learning through the use of a personalized database based on a fusion image using a light sensing element and a wave sensing element.

The present disclosure is not limited to solving the above-described problems, and other aspects and advantages of the present disclosure can be appreciated by those skilled in the art based on the following description and will be understood more clearly from embodiments of the present disclosure. In addition, it will be appreciated that the aspects and advantages of the present disclosure will be easily realized by those skilled in the art based on the appended claims and a combination thereof.

Solution to Problem

In order to solve the above-described problems, there is provided a method for treating laundry according to an embodiment of the present disclosure. The method for treating laundry may be performed by a laundry treating apparatus.

The method for treating laundry according to this embodiment of the present disclosure may include generating fusion sensing data on laundry by using a plurality of heterogeneous sensors, acquiring information about laundry by using fusion sensing data, and a controlling a washing cycle of laundry based on the information about the laundry.

Further, the plurality of heterogeneous sensors may include at least one of a light sensor including a 2D image sensor or a light sensor including a 3D image sensor, and at least one of a wave sensor including an ultrasonic sensor, a wave sensor including radar, or a wave sensor including LiDAR.

Further, the generating fusion sensing data may include generating fusion sensing data on at least one piece of laundry introduced into a washing drum, and determining whether introduction of laundry is completed. The generating fusion sensing data may further include generating fusion sensing data on the laundry while rotating the washing drum after introduction of laundry is completed.

Further, the generating fusion sensing data may include generating sensing data on a type of fabric by using scattering characteristics of a reflected wave of a wave sensor, and generating sensing data on motion characteristics of the laundry depending on rotation of a washing drum based on a density distribution of the laundry.

Further, whether introduction of laundry is completed may be determined through at least one of whether a laundry treating apparatus is turned on, or whether a volume or weight of laundry equal to or greater than a threshold value is sensed.

Further, the generating fusion sensing data may include sensing an open and closed state of a door of an inner tub.

Further, the method for treating laundry may further include displaying at least one selected from the group of information about laundry, information about the washing cycle, and information about a status of the control of the washing cycle, through an output interface of the laundry treating apparatus. The information about laundry may include information about a foreign substance other than laundry.

Further, the method for treating laundry may further include storing in advance reference data to be compared with the fusion sensing data, and information about laundry related thereto. The acquiring information about the laundry by using fusion sensing data may include acquiring information about the laundry by comparing the registered reference data with the fusion sensing data.

Further, the method for treating laundry may further include performing machine learning or deep learning of the information about laundry by using reference data to be compared with fusion sensing data. The acquiring information about the laundry by using fusion sensing data may include acquiring information about the laundry by using a predictive model built using the machine learning or deep learning.

Further, the generating fusion sensing data may include generating fusion sensing data on first-sensed laundry, and storing the fusion sensing data in a personalized database.

A laundry treating apparatus according to another embodiment of the present disclosure is characterized by treating laundry based on a result of processing fusion sensing data.

The laundry treating apparatus according to this embodiment of the present disclosure may include a plurality of heterogeneous sensors configured to generate fusion sensing data on laundry, and a controller configured to acquire information about the laundry by using the fusion sensing data, and control a washing cycle based on the information about the laundry.

Further, the plurality of heterogeneous sensors may include at least one of a light sensor including a 2D image sensor or a light sensor including a 3D image sensor, and at least one of a wave sensor including an ultrasonic sensor, a wave sensor including radar, or a wave sensor including LiDAR.

Further, the controller may be configured to control the sensors so as to generate fusion sensing data on at least one piece laundry introduced into a washing drum, determine whether introduction of laundry is completed, and additionally generate fusion sensing data on the laundry while rotating the washing drum after introduction of laundry is completed.

Further, the controller may include a processor configured to control the sensors so as to generate sensing data on a type of fabric by using scattering characteristics of a reflected wave of a wave sensor, and generate sensing data on a density distribution of laundry based on a motion of laundry depending on a volume of laundry and rotation of the washing drum.

Further, the laundry treating apparatus may include an output interface for displaying at least one selected from the group of information about laundry, information about the washing cycle, and information about a status of the control of the washing cycle. The information about laundry may include information about a foreign substance other than laundry.

Further, the laundry treating apparatus may include a memory for registering and storing in advance reference data to be compared with the fusion sensing data and information about laundry related thereto. The controller may include a processor configured to acquire information about the laundry by comparing the stored reference data with the fusion sensing data.

Further, the controller may include a processor configured to perform machine learning of information about laundry by using reference data to be compared with fusion sensing data. The processor may be configured to acquire information about the laundry by using a predictive model built using the machine learning.

Further, the controller may include a processor configured to perform deep learning of information about laundry by using reference data to be compared with fusion sensing data. The processor may be configured to acquire information about laundry by using at least one selected from the group of a convolution neural network (CNN), a recurrent neural network (RNN), a restricted Boltzmann machine (RBM), a deep belief network (DBN), a generative adversarial network (GAN), and a relation network (RN).

Further, the controller may include a processor configured to control the sensors so as to generate fusion sensing data on first-sensed laundry, and store the fusion sensing data in a memory in a personalized database form.

Advantageous Effects of Invention

According to the present disclosure, it is possible to collect accurate information about laundry by using fusion sensing data based on heterogeneous sensors, and control a washing cycle in a manner suitable for the laundry based on the collected information.

Further, it is possible to sense laundry which is inappropriate for washing, by using a fusion image that uses both light and waves simultaneously.

Further, it is possible to reduce the time required for learning big data, by using a personalized database based on the fusion image that uses a light sensing element and a wave sensing element.

BRIEF DESCRIPTION OF DRAWINGS

The above and other aspects, features, and advantages of the present disclosure will become apparent from the detailed description of the following aspects in conjunction with the accompanying drawings.

DESCRIPTION OF EMBODIMENTS

Figure 1:
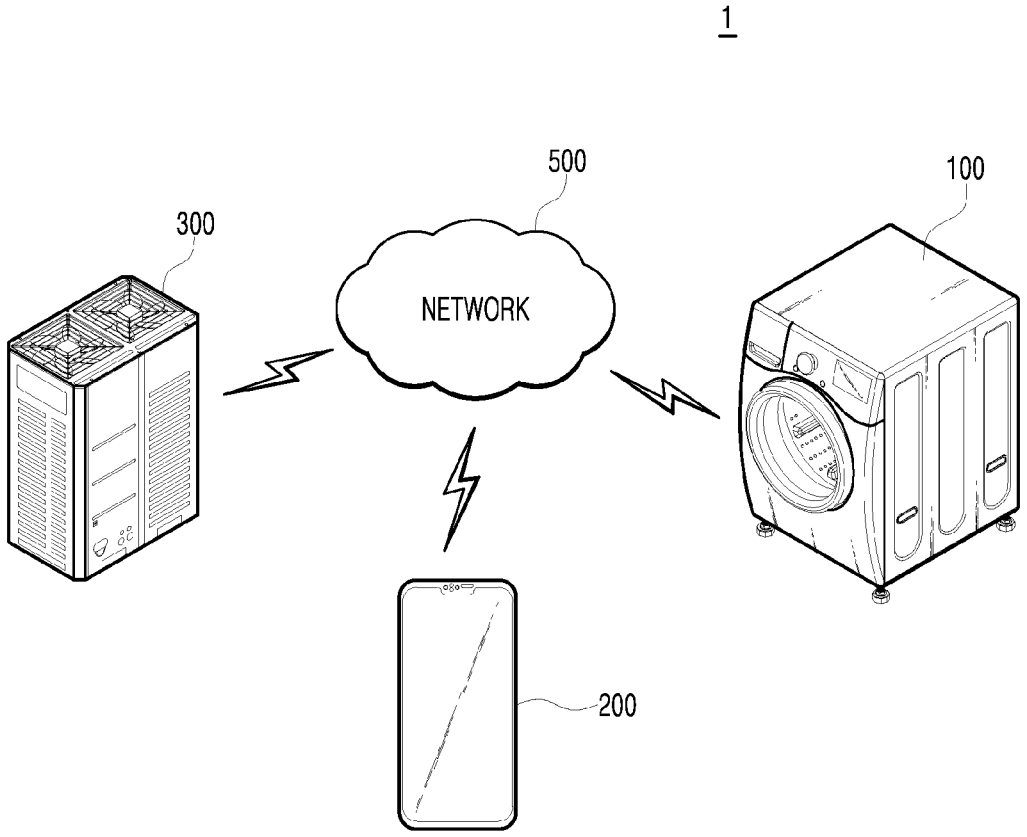
FIG. 1 is an exemplary view illustrating an environment for treating laundry including a laundry treating apparatus, a user terminal, a server, and a network for connecting the laundry treating apparatus, the server, and the network to one another according to an embodiment of the present disclosure.

Hereinafter, preferred embodiments of a method and an apparatus for treating laundry will be described in detail with reference to the accompanying drawings.

Like reference numerals designate like elements throughout the drawings. Also, specific structural or functional descriptions of the embodiments of the present disclosure are exemplarily intended to describe the embodiments according to the present disclosure. Unless otherwise defined, all terms (including technical and scientific terms) used herein as is customary in the art to which the inventive concept of the present disclosure belongs. It will be further understood that terms in common usage should also be interpreted as is customary in the relevant art and not in an idealized or overly formal sense unless expressly so defined herein.

FIG. 1 is an exemplary view illustrating an environment for treating laundry including a laundry treating apparatus, a user terminal, a server, and a network for connecting the laundry treating apparatus, the server, and the network to one another according to an embodiment of the present disclosure.

FIG. 1 illustrates a state in which a laundry treating apparatus 100, a user terminal 200, and a server 300 are communicatively connected to one other by a network 500. The laundry treating apparatus 100 may include a communication unit, and may thereby be capable of transmitting and receiving data to and from the user terminal 200, which corresponds to a personal communication device, and the server 300, through the wired or wireless network 500.

The laundry treating apparatus 100 may receive fusion sensing data through a plurality of sensors, and may control the washing cycle of laundry by using the fusion sensing data.

The user terminal 200 may control the operation of the laundry treating apparatus 100 through the server 300. In addition, the user terminal 200 may receive various notification messages regarding the operation of the laundry treating apparatus 100 from the laundry treating apparatus 100.

The notification messages may include a termination message notifying of the end of laundry treatment, a foreign substance sensing message notifying that a foreign substance other than laundry, such as a metal, wet laundry such as diaper, or the like, has been sensed in an inner tub, and a warning message notifying that a pet or a child has been sensed in a washing machine.

In addition, when the laundry may be damaged, for example when both white clothes and colored clothes are sensed or when non-washable leather clothes are sensed, a warning message may be transmitted to the user terminal 200. A message including a caution or tip for washing or managing specific clothes may be transmitted to the user terminal 200 by using information about laundry collected on the basis of fusion sensing data.

The notification message, foreign substance sensing message, and warning message may be simultaneously transmitted and outputted through the user terminal 200 and a user interface of the laundry treating apparatus 100.

The user terminal 200 may be a wireless communication terminal capable of performing the function of a computing device. Various embodiments of the wireless communication terminal may include a cellular phone, a smart phone having a wireless communication function, a personal digital assistant (PDA) having a wireless communication function, a wireless modem, a portable computer having a wireless communication function, a photographing device such as a digital camera having a wireless communication function, a gaming device having a wireless communication function, an appliance for storing and playing music having a wireless communication function, an Internet appliance capable of accessing and browsing wireless Internet, and a portable unit or terminals incorporating combinations of such functions, but is not limited thereto.

The server 300 may be a database server which provides big data required for applying various artificial intelligence algorithms, and fusion sensing data on laundry. In addition, the server 300 may include a web server or an application server which allows the laundry treating apparatus 100 to be remotely controlled by using an application or web browser installed in the user terminal 200.

The server 300 may receive fusion sensing data from the laundry treating apparatus 100, and transmit, to the laundry treating apparatus 100, information about laundry acquired after an image processing operation is performed on the fusion sensing data. That is, an operation of processing the fusion sensing data may be performed by the server 300.

The network 500 may be a wired and wireless network, for example, a local area network (LAN), a wide area network (WAN), the Internet, an intranet and an extranet, and any suitable communication network including a mobile network, for example, cellular, 3G, 4G, LTE, 5G, and Wi-Fi networks, an ad hoc network, and a combination thereof.

The network 500 may include a connection of network elements such as a hub, bridge, router, switch, and gateway. The network 500 may include one or more connected networks, for example, a multi-network environment, including a public network such as the Internet and a private network such as a secure corporate private network. Access to the network 500 may be provided via one or more wired or wireless access networks.

Hereinafter, components of the laundry treating apparatus 100 related to acquiring information about laundry by using fusion sensing data will be described in detail.

Figure 2:
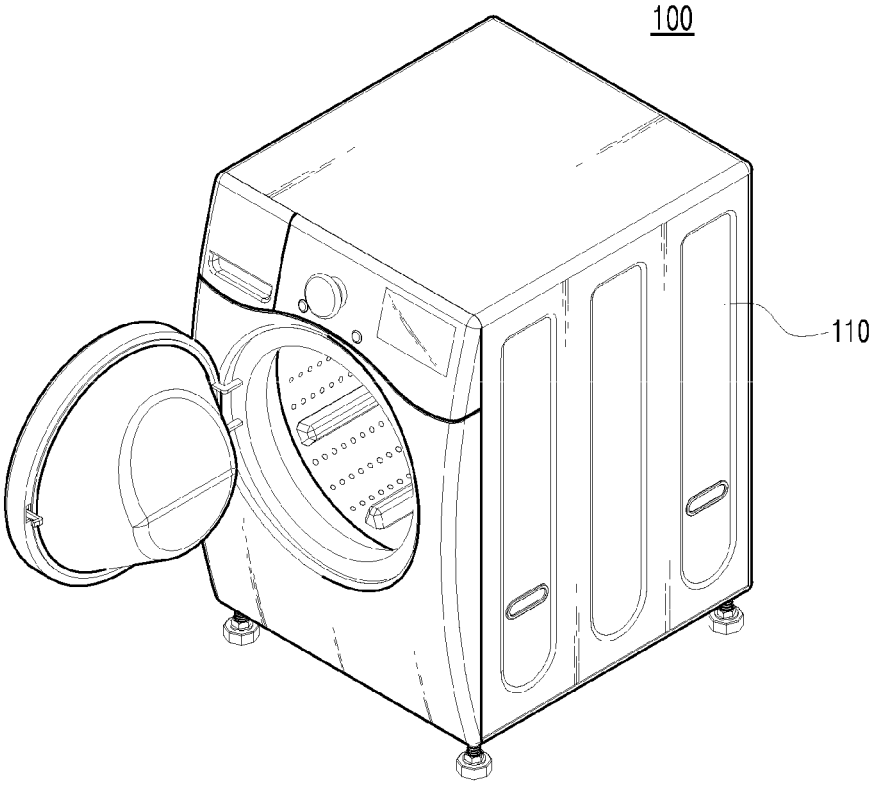
FIG. 2 is an exemplary view illustrating an appearance of a laundry treating apparatus according to an embodiment of the present disclosure.

FIG. 2 is an exemplary view illustrating an appearance of a laundry treating apparatus according to an embodiment of the present disclosure.

FIG. 2 illustrates a laundry treating apparatus 100 capable of controlling a washing cycle of laundry by using fusion sensing data. The laundry treating apparatus 100 may include an inner tub, a door which is openable and closable to allow laundry to be introduced into and removed from the inner tub, and a cabinet 110 corresponding to a housing.

The laundry treating apparatus 100 may include various types of laundry treating apparatus, for example, an impeller-type laundry treating apparatus, a stirring bar-type laundry treating apparatus, and a horizontal drum-type laundry treating apparatus, but is not limited thereto. For ease of explanation, the horizontal drum-type laundry treating apparatus will be described.

In concept, a laundry treating apparatus includes a washing machine and a dryer, and is capable of both washing and drying.

Hereinafter, internal components of the laundry treating apparatus 100 which acquires information about laundry by using fusion sensing data and controls a washing cycle of the laundry based on the information will be described in detail.

Figure 3:
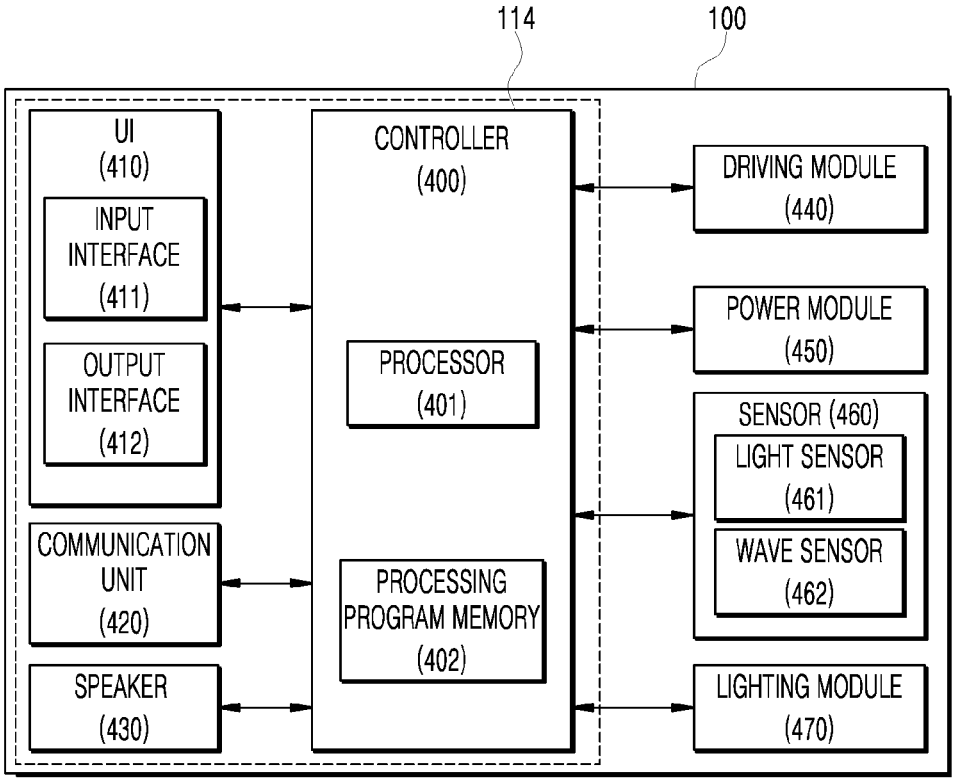
FIG. 3 is a schematic block diagram illustrating a laundry treating apparatus according to an embodiment of the present disclosure.

FIG. 3 is a schematic block diagram illustrating a laundry treating apparatus according to an embodiment of the present disclosure.

FIG. 3 illustrates a laundry treating apparatus 100 including a controller 400, a user interface 410, a communication unit 420, a speaker 430, a driving module 440, a power module 450, sensors 460, and a lighting module 470. Here, the controller 400 may include a processor 401 and a memory 402, and the user interface 410 may include an input interface 411 and an output interface 412.

The controller 400 may serve to control operations of components in the laundry treating apparatus 100, from the user interface 410 to the lighting module 470, as illustrated in FIG. 3.

The controller 400 may include the processor 401 and memory 402. The processor 401 may directly process fusion sensing data collected by a light sensor 461 and a wave sensor 461, or may process the collected fusion sensing data through the server 300. When an image processing operation is performed through the server 300, the fusion sensing data may be transmitted to the server 300 through the communication unit 420, and information about laundry may be received from the server 300 after the image processing operation is completed. The image processing operation may include image synthesizing, image optimization, and the like.

The processor 401 may be implemented in the form of a microcontroller. The processor 401 may control the laundry treating apparatus 100 by performing the command logic of a program for controlling the washing cycle of the laundry treating apparatus 100.

The memory 402 may store a program for controlling the washing cycle. In addition, the memory 402 may store a personalized database collected in a local area. In addition, the memory 402 may store various data received from the server 300.

The user interface 401 may include the input interface 411 and the output interface 412. The input interface 411 may correspond to an input panel of the laundry treating apparatus 100, and the output interface 412 may correspond to an output panel of the laundry treating apparatus 100. The input panel and the output panel may be located at the top of a front surface of the laundry treating apparatus 100.

The communication unit 420 may serve to connect the laundry treating apparatus 100 to the network 500. The communication unit 420 may include components required for connection to the network 500 illustrated in FIG. 1. For example, the communication unit 420 may include a USB interface, a serial communication interface, a short-range wireless communication interface such as Zigbee, Bluetooth™, or the like, and a wireless LAN interface such as Wi-Fi or the like The speaker 430 may output a warning sound together with various notification messages, or a warning message, depending on the output interface 412.

The driving module 440 may include a mechanical device related to the laundry treatment of the laundry treating apparatus 100 and an electronic device for driving the mechanical device. The drive module 440 may include, for example, an electronic valve, an inlet and a drain pump for controlling various wash water flows, various motors for drum and drainage, a clutch and a capacitor for controlling the motors, and the like.

The sensors 460 may be configured to include the light sensor 461 and the wave sensor 462. In addition, although not illustrated in FIG. 3, the sensors 460 may further include a sensor for sensing a chemical remaining in wash water, and an olfactory sensor for sensing a contaminated washing substance.

The light sensor 461 may be configured to include at least one of a visible light sensor, an ultraviolet light sensor, or an infrared sensor. The light sensor 461 may include a plurality of light sensors, thereby being capable of collecting two-dimensional image data and three-dimensional image data.

The light sensor 461 may sense whether a pet or child has entered the drum. When a shape of a human or animal is sensed by means of image processing, or the entry of a pet or child is sensed by sensing a motion or sensing a temperature through an infrared sensor, a warning sound may be outputted through the output interface, and a warning message or the like may be transmitted to the user terminal 200.

The wave sensor 462 may be configured to include at least one of a wave sensor including an ultrasonic sensor, a wave sensor including radar, or a wave sensor including LiDAR.

The wave sensor 462 may collect sensing data which varies depending on roughness of a surface of laundry introduced into a drum and a moisture content of the laundry by reflecting an incident wave with a specific wavelength band onto the surface of the laundry, and collecting reflected waves reflected from the surface of the laundry.

For example, when the laundry has a flat surface, more forward scattering than back scattering may occur on a reflective surface of the surface of the laundry. When laundry has a rough surface, relatively less forward scattering may occur. Accordingly, through features of the sensing data collected by the wave sensor 462, a fabric type of the laundry may be sensed.

Further, in the case of laundry containing moisture, such as a diaper, relatively large forward scattering may occur on the surface of the laundry, and thereby wet laundry may be sensed. In this case, a user message may be transmitted, allowing the wet laundry to be separated from the other laundry.

By using a time-series characteristic of a wavelength and characteristics of an incident wave and a reflected wave, the wave sensor 461 may output sensing data which forms the basis of sensing a type of laundry by using motion characteristics of the laundry moving in the washing drum.

The washing drum may be provided with paddles, and accordingly the laundry may be caught by the paddles and rotate with the rotation of the washing drum, and may fall to a different position in the washing drum in response to a change in the rotation speed of the washing drum. The motion characteristics of the laundry may be related to a weight and a volume of the laundry, that is, a density of the laundry. The density may be related to a type of the laundry. Accordingly, it is possible to identify a type of the laundry through the motion characteristics of the laundry based on the rotation of the washing drum.

In addition, a foreign substance contained in the laundry may be sensed through a reflected wave generated by the wave sensor 461. For example, when the laundry contains metal, such as a coin or the like, such a foreign substance may be sensed by using characteristics of the reflected wave of the wave sensor 461.

The lighting module 470 may serve to produce an illumination suitable for the operation of the sensor in the washing drum by emitting light. The lighting module 470 may be implemented as an LED device.

Hereinafter, internal components of the laundry treating apparatus 100 will be described in detail with respect to installation locations of the sensors 460.

Figure 4:
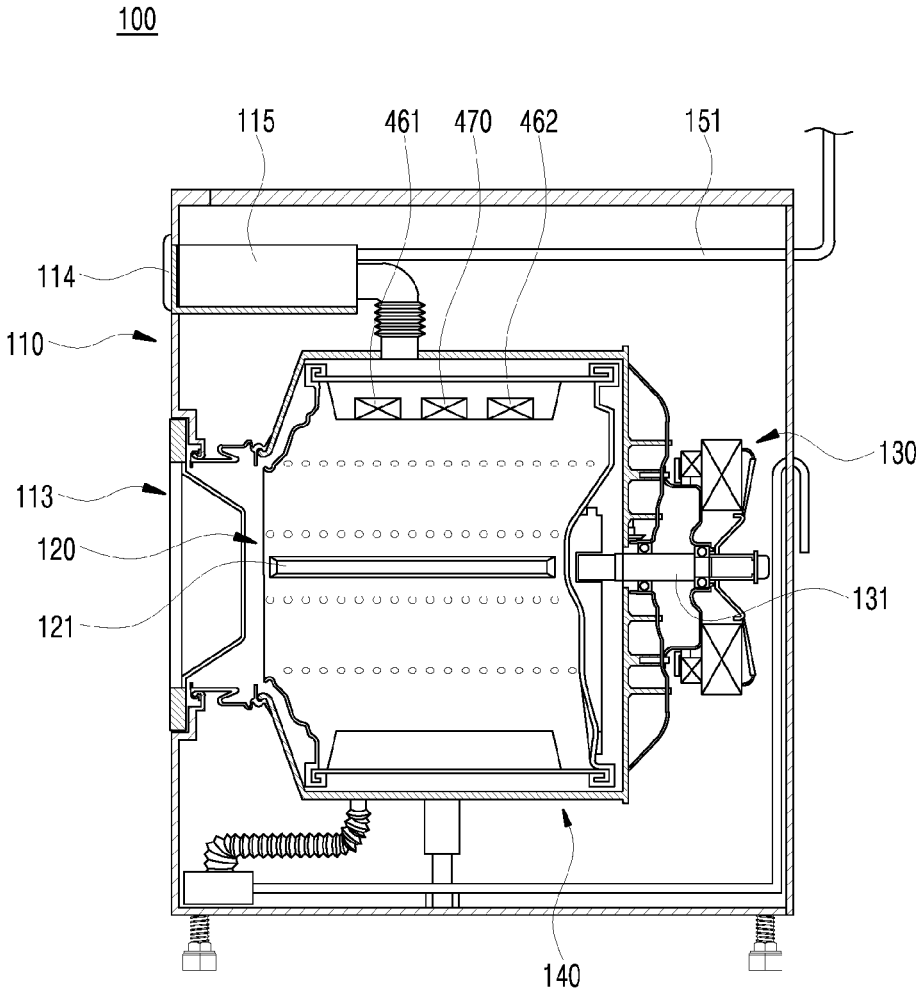
FIG. 4 is a cross-sectional view illustrating a laundry treating apparatus according to an embodiment of the present disclosure, in which locations of sensors are illustrated.

FIG. 4 is a cross-sectional view illustrating a laundry treating apparatus according to an embodiment of the present disclosure, in which locations of sensors are illustrated.

FIG. 4 illustrates a side cross-section of the laundry treating apparatus 100. Various components of the laundry treating apparatus 100 may be installed in the cabinet 110 corresponding to the housing.

The front surface of the laundry treating apparatus 100 may be provided with a door 113 for allowing laundry to be introduced and removed. When the door 113 is opened, there may be a drum 120 located inside the laundry treating apparatus 100. A tub including a drum, that is, an inner tub, may be located inside the laundry treating apparatus 100.

The plurality of sensors 460 and the lighting module 470 may be located on an inner surface of the drum. The sensors 460 and the lighting module 470 located on the inner surface of the drum may be waterproofed, and may rotate together with the drum when the drum rotates.

A plurality of paddles 121 for catching laundry may be installed inside the washing drum 120 so that the laundry may rotate together with the washing drum 120. The laundry may rotate together with the drum 120 by being caught by the paddles.

A control panel 114 may be located at the top of the front surface of the laundry treating apparatus 100, and the control panel 114 may include the controller 400 and components incorporated in a PCB related thereto.

A motor 130 and a driving shaft 131 may be located on a rear surface of the laundry treating apparatus 100. A detergent drawer 115 corresponding to a dispenser of a chemical detergent, may be located at the top of the laundry treating apparatus 100, and a water supply pipe 151 may be located on an upper rear surface of the laundry treating apparatus 100.

Hereinafter, a method for treating laundry according to an embodiment of the present disclosure will be described in relation to a washing cycle controlled by means of the processor 401 and the memory 402 which are components of the controller 400 of the laundry treating apparatus 100, the sensors 460, and the lighting module 470.

Figure 5:
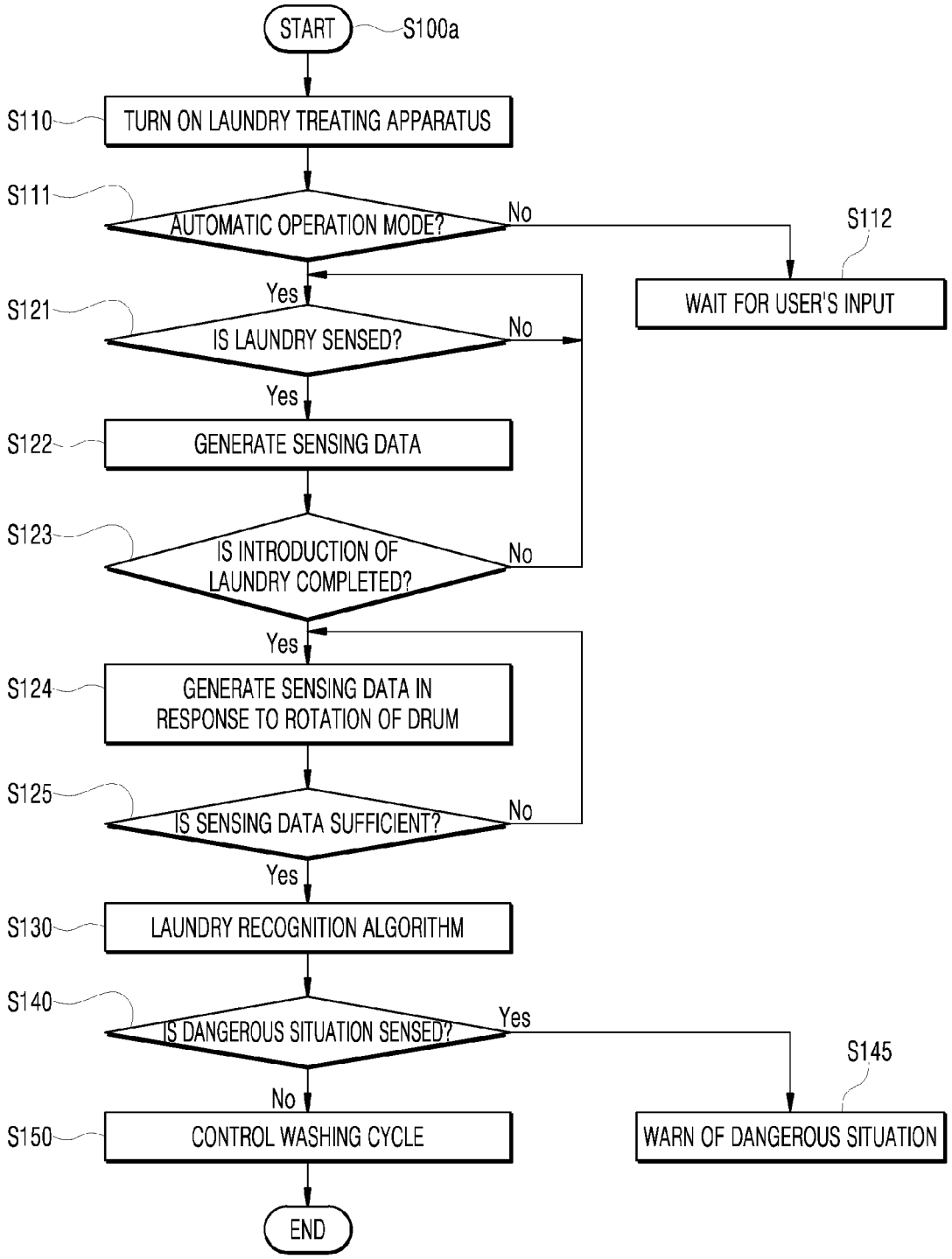
FIG. 5 is a flowchart illustrating a method for treating laundry according to an embodiment of the present disclosure.

FIG. 5 is a flowchart illustrating a method for treating laundry according to an embodiment of the present disclosure.

Referring to FIG. 5, a method for treating laundry S100*a* according to an embodiment of the present disclosure may include steps S110 to S150.

The method for treating laundry S100*a* according to an embodiment of the present disclosure may develop differently depending on whether the laundry treating apparatus 100 is turned on or turned off. When power of the laundry treating apparatus 100 is in an ON state, laundry is likely to be treated immediately after the laundry is introduced into the laundry treating apparatus 100. However, when initial power of the laundry treating apparatus 100 is in an OFF state, the laundry may be treated after the power of the laundry is automatically or manually switched from the OFF state to the ON state, after the laundry is introduced into the laundry treating apparatus 100.

Hereinafter, a case where the initial power of the laundry treating apparatus 100 is in the ON state and a case where the initial power of the laundry treating apparatus 100 is in the OFF state will be described separately.

First, the power of the laundry treating apparatus 100 may be switched from the OFF state to the ON state. The power may be applied by a user, or may be automatically applied by means of a timer.

Next, the laundry treating apparatus 100 may determine whether a washing cycle is in an automatic operation mode (S111). When the washing cycle is in the automatic operation mode, a subsequent step of sensing laundry may be performed. Otherwise, the laundry treating apparatus 100 may wait for the user's input (S112), and the washing cycle may be performed in response to the user's input.

Next, the laundry treating apparatus 100 may generate fusion sensing data on the laundry by using a plurality of heterogeneous sensors 460.

The laundry treating apparatus 100 may sense the laundry introduced into the drum by using the sensors 460 and the lighting module 470 (S121). In this case, a sensor for sensing a weight of the laundry may be additionally used. A laundry sensing operation may continue in response to the introduction of the laundry.

The laundry treating apparatus 100 may generate fusion sensing data by using the plurality of sensors 460 including the light sensor 461 and wave sensor 462 with respect to the sensed laundry (S122).

A process of collecting fusion sensing data may be performed in two steps.

The laundry treating apparatus 100 may generate fusion sensing data on at least one piece of laundry introduced into the washing drum (S121). In this case, the user may introduce pieces of laundry one by one when the door 113 of the laundry treating apparatus 100 is open.

Next, the laundry treating apparatus 100 may determine whether introduction of laundry is completed (S123). Here, whether the introduction of the laundry is completed may be determined through at least one of whether the laundry treating apparatus is turned on or whether a volume or weight of the laundry equal to or greater than a threshold value is sensed. The door 113 may be provided with a sensor for sensing an open and closed state thereof, and accordingly the laundry treating apparatus 100 may sense whether the door is open or closed.

Next, after the introduction of the laundry is completed, the laundry treating apparatus 100 may generate fusion sensing data on the laundry while rotating the washing drum 120 (S124).

In particular, the laundry treating apparatus 100 may generate sensing data on a type of fabric by using scattering characteristics of a reflected wave of the wave sensor 462.

In addition, the laundry processing apparatus 100 may generate sensing data on motion characteristics of the washing drum according to rotation of the washing drum based on a density distribution of the laundry.

Next, the laundry treating apparatus 100 may determine whether the sensing data is sufficient (S125). When the sensing data is insufficient, the laundry treating apparatus 100 may further rotate the drum to additionally collect fusion sensing data by using the motion characteristics of the laundry according to the rotation.

Next, the laundry treating apparatus 100 may acquire information about the laundry by using the fusion sensing data (S130). An image processing operation using various laundry recognition algorithms may be performed in the process of acquiring information about the laundry.

In addition, the laundry treating apparatus 100 may sense a dangerous situation resulting from the presence of a pet or young children in the drum, by using the sensors 460 and the lighting module 470 (S144). In this case, the laundry treating apparatus 100 may output a warning screen and a warning sound through the output interface 412 and the speaker 430, and may transmit a warning message to the user terminal 200 (S145).

Next, the laundry treating apparatus 100 may control the washing cycle of the laundry based on the information about the laundry (S150).

Here, an overall washing cycle step may be configured in various ways depending on the information about the laundry. The step of the washing cycle may be configured as a combination of a soaking step, a washing step, a rinsing step, a spin-drying step, and a drying step. Depending on the information about the laundry, selection of each constituent step and the time allocation of each of the constituent steps may be combined differently.

According to an embodiment of the present disclosure, the step S120 of generating fusion sensing data may include sensing an open and closed state of the door of the inner tub. A method for treating laundry which includes automatically or manually switching the power of the laundry treating apparatus from the OFF state to the ON state together with the sensing of the open state of the door of the inner tub, will be described below.

Figure 6:
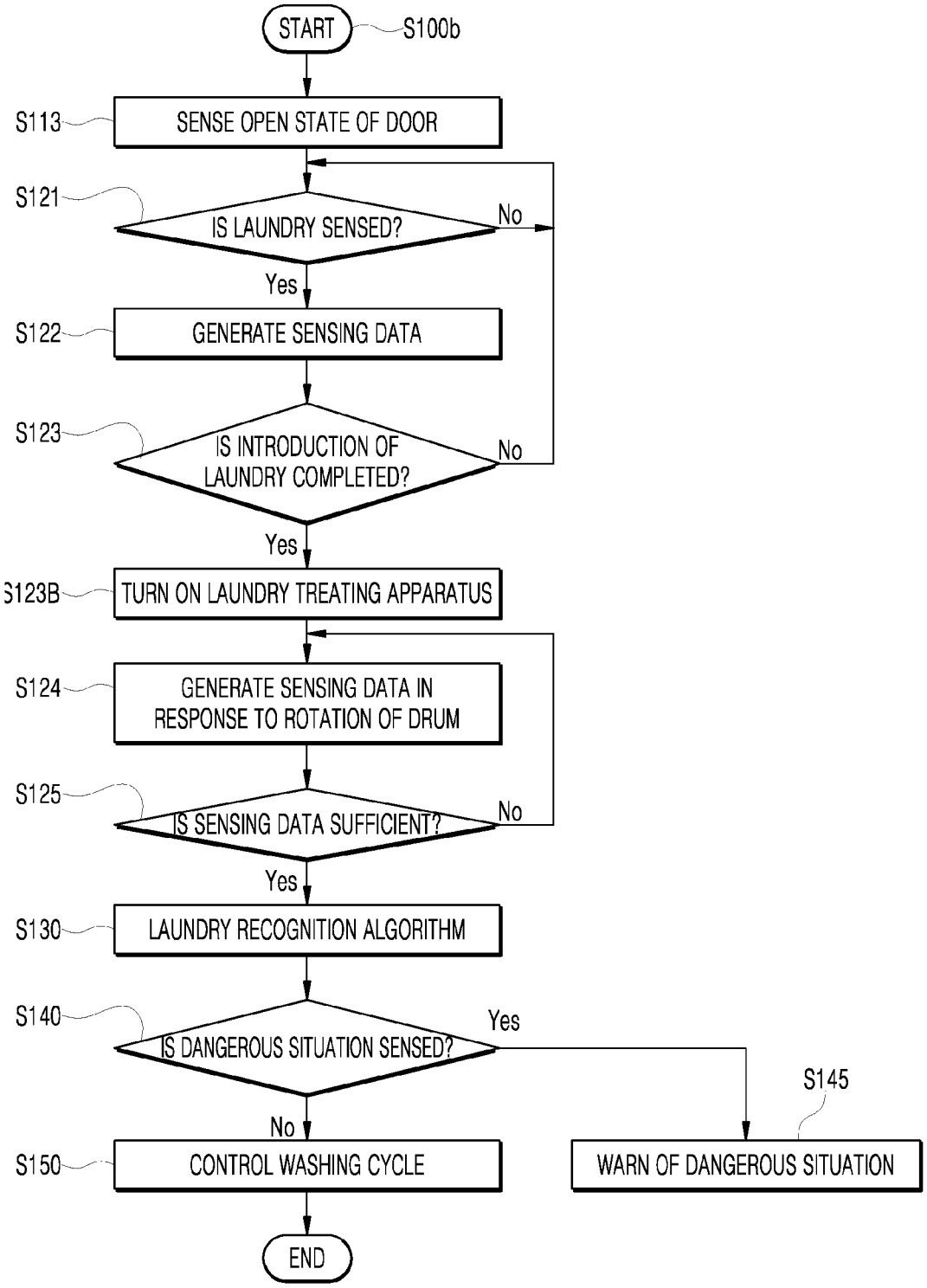
FIG. 6 is a flowchart illustrating a method for treating laundry according to an embodiment of the present disclosure.

FIG. 6 is a flowchart illustrating a method for treating laundry according to an embodiment of the present disclosure.

Referring to FIG. 6, the method for treating laundry S100*b* according to an embodiment of the present disclosure may include steps S113 to S145.

The following description focuses on the differences between FIG. 5 and FIG. 6. In step S113, the laundry treating apparatus 100 may sense whether a door is in an open state. When the open state of the door is sensed and laundry is introduced into the drum, the laundry treating apparatus 100 may sense the laundry (S121).

Next, the laundry treating apparatus 100 may generate fusion sensing data on the sensed laundry (S122). In response to the laundry introduced by the user, the laundry treating apparatus 100 may generate fusion sensing data on each accumulated piece of laundry by using the sensors 460 and the lighting module 470. The laundry treating apparatus 100 may continue to generate fusion sensing data until the introduction of the laundry is completed.

Next, the laundry treating apparatus 100 may determine whether the introduction of the laundry is completed or not (S123). Whether the introduction of the laundry is completed may be determined according to whether a weight and a volume of the laundry exceed a threshold value, whether the door of the inner tub is sensed to have moved to the open state from the closed state, and a pattern of the laundry in the inner tub based on previously accumulated fusion sensing data.

For example, There may be a pattern that laundry such as hosiery may not be mixed with other laundry, and may have a pattern of being washed solely. Further, there may be a pattern that laundry such as first-sensed laundry may be virgin laundry which is washed solely, in order to wash out remaining chemicals used for treatment during the production process in a factory. These patterns may be determined through an artificial intelligence algorithm. The pattern of being washed solely may be determined through an artificial intelligence algorithm. The remaining steps in FIG. 6 may be described in accordance with the corresponding steps in FIG. 5.

Figure 7:
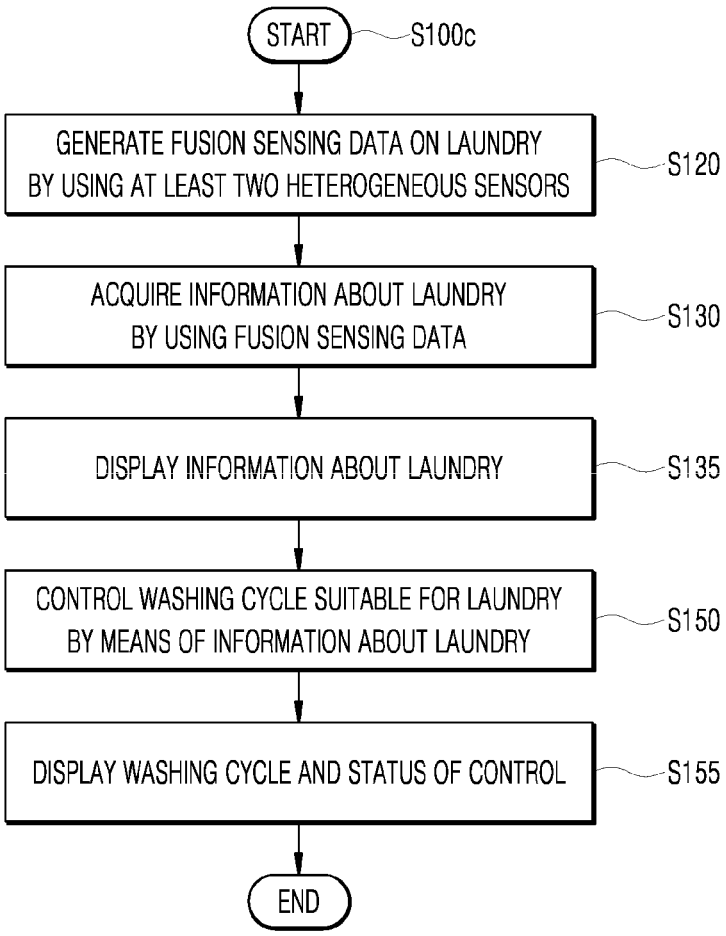
FIG. 7 is a flowchart illustrating a method for treating laundry according to an embodiment of the present disclosure.

FIG. 7 is a flowchart of a method for treating laundry according to an embodiment of the present disclosure.

Referring to FIG. 7, a method for treating laundry S100*c* according to an embodiment of the present disclosure may include steps S120 to S155.

A step of outputting various information through the output interface 412 may include steps S120 to S155.

After the laundry treating apparatus 100 acquires information about the laundry (S120, S130), the laundry treating apparatus 100 may display at least one selected from the group of information about the laundry, information about the washing cycle, and information about a status of the control of the washing cycle, through the output interface 412 of the laundry treating apparatus 100 (S135 and S155).

In this case, the information about the laundry may include information about a foreign substance other than laundry. The foreign substance may include laundry containing moisture, such as a diaper or the like, metal such as a coin or the like, a non-washable leather product, and the like. Using the fusion sensing data, the laundry treating apparatus 100 may sense the foreign substance based on the characteristics of the reflected wave.

Figure 8:
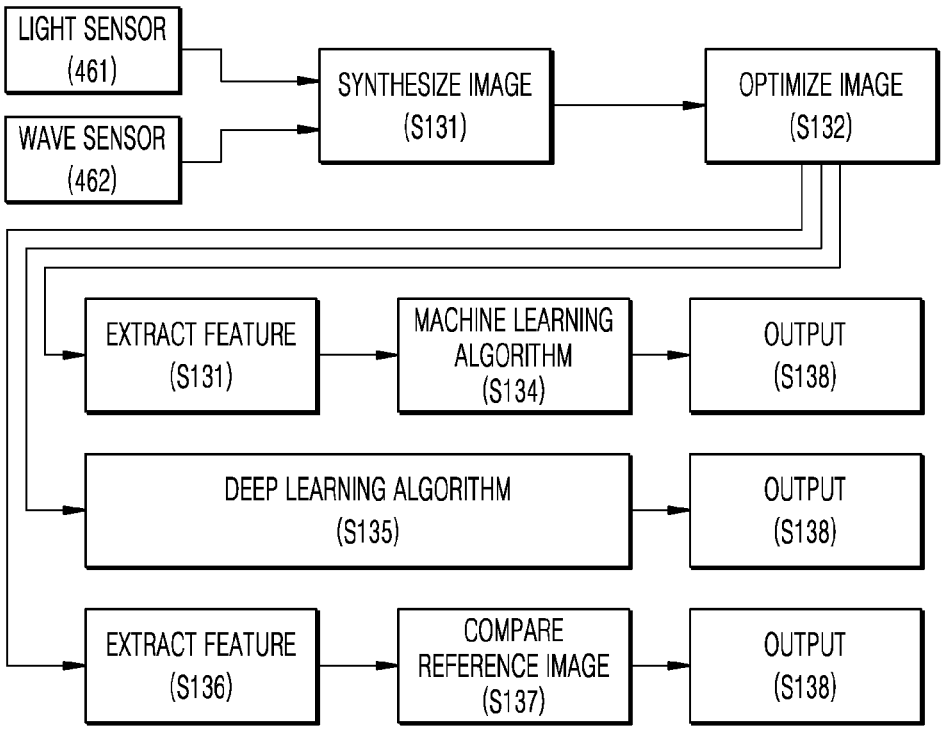
FIG. 8 is a flowchart illustrating a process of outputting information about laundry according to an embodiment of the present disclosure.

FIG. 8 is a flowchart illustrating a process of outputting information about laundry according to an embodiment of the present disclosure.

FIG. 8 illustrates constituent steps of a process of preprocessing fusion sensing data collected through the light sensor 461 and the wave sensor 462, and finally outputting information about laundry.

The fusion sensing data may be subjected to a preprocessing process including synthesizing an image (S131) and optimizing an image (S132).

In the preprocessing process, the fusion sensing data may be synthesized between different images. Image synthesizing may occur entirely or partially in the total area of an image. However, image synthesizing may be optional, and thus data collected by the light sensor 416 and data collected by the wave sensor 462 may be independently processed without being synthesized with each other.

The step of optimizing an image S132 may include a processing operation related to noise removal, brightness adjustment, gamma value adjustment, and the like, of image data.

The fusion sensing data may be subjected to an information analysis step to acquire information about the laundry, after the preprocessing process. The information analysis step may include extracting a feature (S131) and using a machine learning algorithm (S134), using a deep learning algorithm (S133), and extracting a feature (S136) and comparing a reference image (S137).

Specifically, the method for treating laundry S100 may further include storing in advance reference data to be compared with the fusion sensing data, and information about laundry related thereto. Here, the storing of the reference data in advance denotes a process of creating and storing a learning model for using a machine learning algorithm or a deep learning algorithm.

Acquiring information about laundry by using the fusion sensing data may include acquiring information about laundry by comparing the registered reference data and the fusion sensing data. Here, the comparing of the registered reference data and the fusion sensing data denotes acquiring information about laundry by using the fusion sensing data in response to the machine learning algorithm or the deep learning algorithm based on the learning model.

Further, the acquiring of information about laundry by using the fusion sensing data may further include performing machine learning or deep learning of the information about laundry by using the reference data to be compared with the fusion sensing data. The acquiring of information about laundry by using the fusion sensing data may include acquiring information about laundry by using a predictive model built using the machine learning or the deep learning.

Further, the generating fusion sensing data may include generating fusion sensing data on first-sensed laundry, and storing the generated fusion sensing data in a personalized database.

Algorithms relating to machine learning constitute one branch of the field of artificial intelligence. Among such algorithms, deep learning algorithms may include various types of networks, such as a convolution neural network (CNN), a recurrent neural network (RNN), a restricted Boltzmann machine (RBM), a deep belief network (DBN), a generative adversarial network (GAN), a relation network (RN), and the like.

The personalized database may be used to acquire information about laundry by using data collected in a local area, unlike the machine learning or deep learning using big data. In a state in which the reference image has been stored in the personalized database, the laundry treating apparatus 100 may acquire information about the laundry using only a processing operation performed in the local area, by comparing the inputted fusion sensing data with the reference data.

As described above, according to an embodiment of the present disclosure, it is possible to collect accurate information about laundry by using fusion sensing data based on heterogeneous sensors, and to control a washing cycle in a manner suitable for the laundry based on the collected information.

Further, it is possible to sense laundry which is inappropriate for washing, by using a fusion image that uses both light and waves simultaneously.

Furthermore, it is possible to reduce the time required for learning big data, by using a personalized database based on a fusion image that uses a light sensing element and a wave sensing element.

Many modifications to the above embodiments may be made without altering the nature of the invention. The dimensions and shapes of the components and the construction materials may be modified for particular circumstances. While various embodiments have been described above, it should be understood that they have been presented by way of example only, and not as limitations.

DESCRIPTION OF SYMBOLS

| | |
|---|---|
| 100: Laundry treating apparatus | 110: Cabinet |
| 114: Control panel | 200: User terminal |
| 300: Server | 400: Controller |
| 401: Processor | 402: Memory |
| 410: User interface | 411: Input interface |
| 412: Output interface | 410: Communication unit |
| 430: Speaker | 440: Driving module |
| 450: Power module | 460: Sensor |
| 461: Light sensor | 462: Wave sensor |
| 470: Lighting module | 500: Network |

The invention claimed is:

1. A laundry treating apparatus characterized by treating laundry based on a result of processing fusion sensing data, the laundry treating apparatus comprising:

a plurality of heterogeneous sensors configured to generate fusion sensing data on laundry; and a controller configured to acquire information about the laundry by using the fusion sensing data, and control a washing cycle based on the information about the laundry, wherein the controller includes a processor configured to control the plurality of heterogeneous sensors to generate sensing data on a type of fabric by using scattering characteristics of a reflective wave of a wave sensor reflected from a surface of the laundry, and generate sensing data on a type of the laundry by using motion characteristics of the laundry depending on rotation of a washing drum based on a density distribution of the laundry.

2. The apparatus according to claim 1, wherein the plurality of heterogeneous sensors comprise:

at least one of a light sensor including a 2D image sensor or a light sensor including a 3D image sensor; and at least one of a wave sensor including an ultrasonic sensor, a wave sensor including radar, or a wave sensor including LiDAR.

3. The apparatus according to claim 1, wherein the controller is configured to control the plurality of heterogeneous sensors to generate fusion sensing data on at least one piece of laundry introduced into the washing drum, determine whether introduction of the laundry is completed, and additionally generate fusion sensing data on the laundry while rotating the washing drum after the introduction of the laundry is completed.

4. The apparatus according to claim 1, further comprising:

an output interface for displaying at least one selected from the group of information about the laundry, information about the washing cycle, and information about a status of the control of the washing cycle, wherein the information about the laundry includes information about a foreign substance other than laundry.

5. The apparatus according to claim 1, further comprising:

a memory for registering and storing in advance reference data to be compared with the fusion sensing data and information about laundry related thereto, wherein the processor is further configured to acquire information about the laundry by comparing the stored reference data with the fusion sensing data.

6. The apparatus according to claim 1, wherein the processor is further configured to perform machine learning of information about laundry by using reference data to be compared with the fusion sensing data, and acquire information about the laundry by using a predictive model built using the machine learning.

7. The apparatus according to claim 1, wherein the processor is further configured to perform deep learning of information about laundry by using reference data to be compared with the fusion sensing data, and the processor is configured to acquire information about the laundry by using at least one selected from the group of a convolution neural network (CNN), a recurrent neural network (RNN), a restricted Boltzmann machine (RBM), a deep belief network (DBN), a generative adversarial network (GAN), and a relation network (RN).

8. The laundry treating apparatus of claim 1, wherein the processor is further configured to control the plurality of heterogeneous sensors so as to generate fusion sensing data on first-sensed laundry, and store the fusion sensing data in a memory in a personalized database form.

* * * * *